United States Patent [19]

Szymborski

[11] 4,049,260

[45] Sept. 20, 1977

[54] APPARATUS FOR FEEDING SHEETS

[75] Inventor: Andrew M. Szymborski, Mountainside, N.J.

[73] Assignee: General Corrugated Machinery Co., Inc., Palisades Park, N.J.

[21] Appl. No.: 711,480

[22] Filed: Aug. 4, 1976

[51] Int. Cl.[2] ..... B65H 1/30

[52] U.S. Cl. ..... 271/151; 271/3.1; 214/6 C; 214/6 D; 214/8.5 A

[58] Field of Search ..... 271/3.1, 149–151; 198/443; 214/1 Q, 1 QA, 6 C, 6 D, 7, 8.5 A

[56] References Cited

U.S. PATENT DOCUMENTS

| | | | |
|---|---|---|---|
| 3,201,114 | 8/1965 | Swartz et al. | 271/150 X |
| 3,422,969 | 1/1969 | Miller et al. | 271/3.1 UX |
| 3,459,420 | 8/1969 | Huntwork | 271/150 |
| 3,881,718 | 5/1975 | Fernandez-Rana et al. | 271/150 X |

*Primary Examiner*—Robert W. Saifer
*Attorney, Agent, or Firm*—Samuelson & Jacob

[57] ABSTRACT

Apparatus for feeding sheets such as flat, corrugated paperboard sheets used to be formed into packaging cases including an entrance end and an exit end, means for receiving a stack of horizontal sheets at the entrance end, a conveyor for receiving the stack of horizontal sheets, means associated with the conveyor for placing the stack of horizontal sheets in an orientation wherein the sheets rest on their edges such that they will be delivered at the exit end in the desired faced orientation, means for supporting the sheets in the edge resting orientation such that the face of the leading sheet and the bed of the conveyor form an acute angle facing the exit end of the apparatus, means for delivering the sheets horizontally in the desired faced orientation to the exit end of the apparatus.

6 Claims, 11 Drawing Figures

APPARATUS FOR FEEDING SHEETS

The invention relates to apparatus for feeding sheets such as corrugated paperboard case blanks. More particularly, the invention is directed toward accepting a stack of horizontal sheets and delivering them as a continuous flow of shingled horizontal sheets in a desired faced orientation to a magazine, hopper, other receptacle or the input of a further machine. This invention is an alternative to that of the copending applications of George A. Ventz Ser. No. 711,479, filed Aug. 4, 1976 and Joseph A. Zeblisky Ser. No. 711,617, filed Aug. 4, 1976 which are owned by the assignee hereof.

Various constructions have been disclosed in the prior art for operating upon a stack of horizontal sheets to accomplish the purpose of the apparatus described herein. One of the earliest of such disclosures is contained in U.S. Pat. No. 3,422,969, issued Jan. 21, 1969, which is owned by the assignee hereof. Since that patent issued and other work in the field was done by the assignee hereof and others, it became evident that certain additional improvements were needed in order to obtain the high performance necessary for economical commercial operation on a production line.

For example, it has been found that one obtains clumps of sheets which do not feed evenly if the leading sheets from a subsequent stack do not properly contact the trailing sheets from the previous stack. As a consequence, manual control of the feed must be exercised from the time a stack of horizontal sheets enters the apparatus until the sheets are delivered at the exit.

Another difficulty with the prior art apparatus arises when the sheets are deposited on the conveyor so that they do not shingle properly and become misaligned in the transverse dimension of the machine. In either of the above described cases, it is necessary for the machine operator to straighten the sheets out by hand. While this may appear an appropriate technique for solving the problems, it is uneconomical, time consuming and perhaps inviting of accidents. Too often, operating personnal become impatient and, as a consequence, take some careless action because of their frustration with the less than perfect operation of the machine.

The apparatus for feeding sheets of the instant invention is directed toward overcoming the inherent difficulties of the prior art methods and devices. In particular, the invention is directed toward obtaining a smoothly operating efficient result with a minimum of manual operation.

Broadly, the invention provides for receiving a stack of horizontal sheets and holding the stack at the entrance until the conveyor is ready to receive it. When a first predetermined condition is met, the stack is fed onto the conveyor and is placed so that the individual sheets rest on their edges and will be in the desired faced orientation at the exit. The faces of the edge resting sheets form an acute angle with the conveyor which angle faces the exit. The sheets are held in this position until a second predetermined condition is reached. At that time, the sheets are pushed forward so that the leading sheet contacts the trailing sheet of the previous stack of sheets. The sheets now drop onto the conveyor to deliver them in shingled fashion to the exit. Frequently, the sheets are collected in a magazine or hopper but they may be delivered to any other device such as the input of a printer-slotter or other machine.

It is an important object of the invention to provide apparatus for delivering a continuous flow of sheets at the exit in a desired face orientation.

It is a further object of the invention to provide means for delivering a stack of horizontal sheets to the entrance when a first predetermined condition is reached.

It is another object of the invention to provide a means for supporting the sheets on their edges with the faces of the sheets and the conveyor bed forming an acute angle facing the exit until a second predetermined condition is reached.

It is a still further object to move the edge resting sheets so that its leading sheet is in contact with the trailing sheet of the previous stack after the second predetermined condition is reached.

These and other objects, advantages, features and uses will be apparent during the course of the following description when taken together with the accompanying drawing wherein:

FIGS. 1–6 are diagrammatic side elevational views of various steps in the operation of a preferred embodiment of the invention;

FIGS. 7 and 7A, joined on the lines A—A, together depict a side elevational view of the embodiment of FIGS 1–6 on a larger scale;

Figure 1:
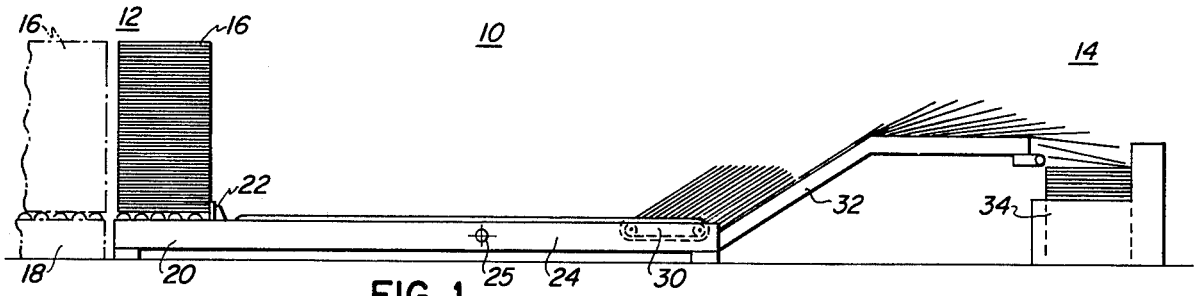

In the drawing, wherein, for the purpose of illustration, there is shown a preferred embodiment of the invention and wherein, like numerals designate like parts throughout the same, the numeral 10 designates an apparatus or machine of the invention, generally. Machine 10 is provided with an entrance or entrance end 12 and an exit or exit end 14.

A customer's conveyor 18 is adjacent the entrance end 12 which is provided with an infeed conveyor 20. The infeed conveyor 20 utilizes at least one stop or gate 22 to preclude movement of a stack 16 of horizontal sheets beyond the infeed conveyor 20 until the machine 10 is ready for it. It is sometimes desirable to raise and lower conveyor 20 to accommodate for the difference in the heights of the customer's conveyor and the main conveyor. In such a case motor M-10 is used to do so.

Two sets of orienting slats or forks 26 and 28 are associated with main conveyor 24 and are pivoted at the area 25 which is designated the upsetting position. In the embodiment illustrated, the longer (or inner) forks 26 contact the edges of the sheets and the shorter (or outer) forks 28 contact the face of the bottom sheet. In some machines, in which very large sheets are processed, outer forks 28 may be equal in length or longer than inner forks 26. Moreover, while the particular embodiment of the invention described and shown herein is used to deliver the sheets at the exit 14 in the same faced orientation in which they enter the machine, the invention is equally useful on machines in which the faced orientation of the sheets is reversed in the apparatus.

Interleaved with main conveyor 24, there is a short intermediate conveyor section 30 which is movable among three positions. The details of the operation of this conveyor section 30 are described in the aforesaid application of George A. Ventz. Since the section 30 is not a part of this invention, the details are not repeated here.

Figure 2:
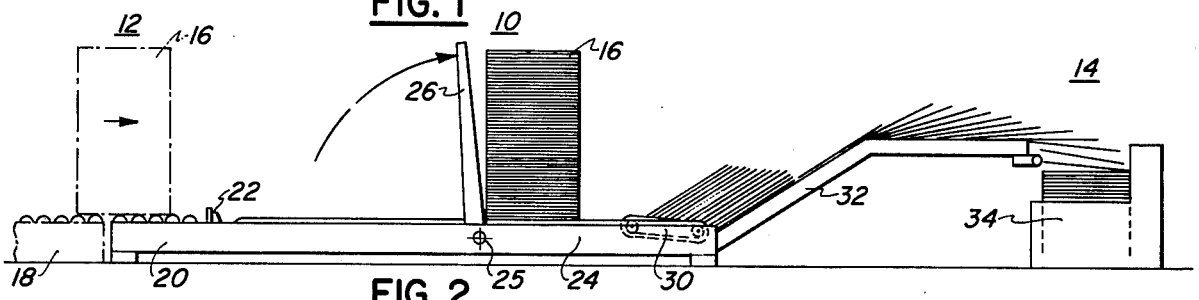
Figure 3:
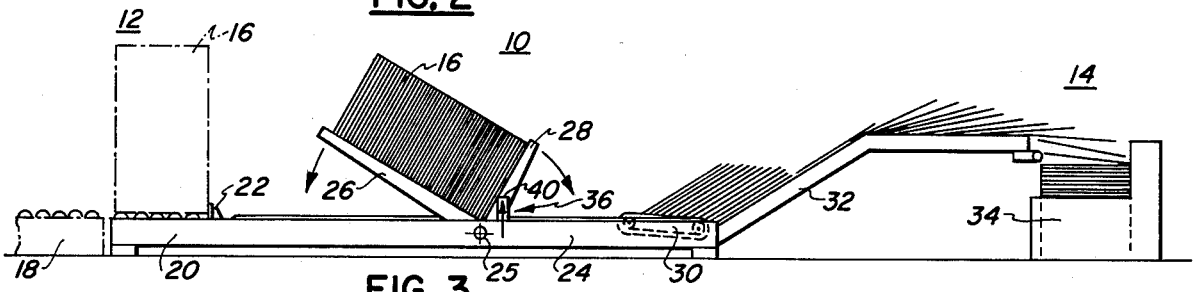
Figure 4:
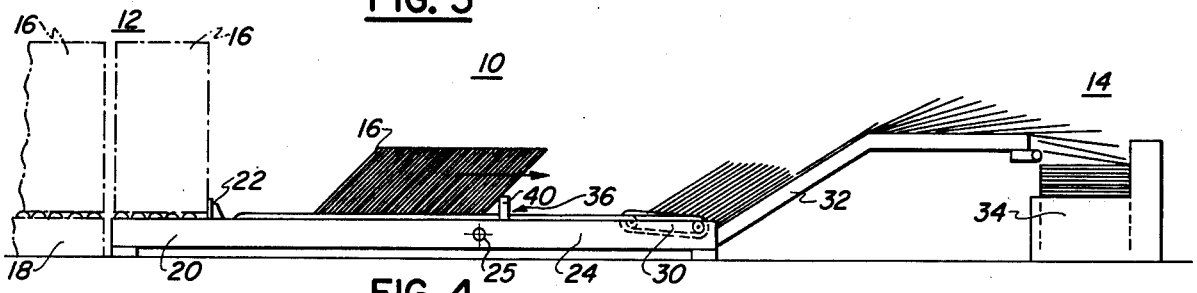
Figure 5:
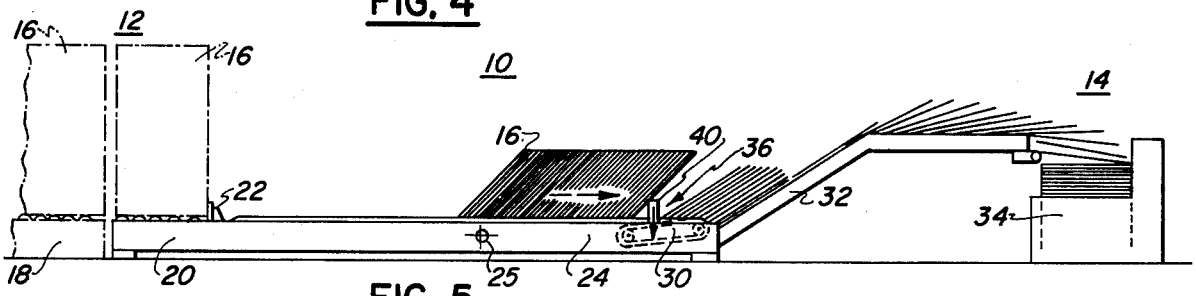
Figure 6:
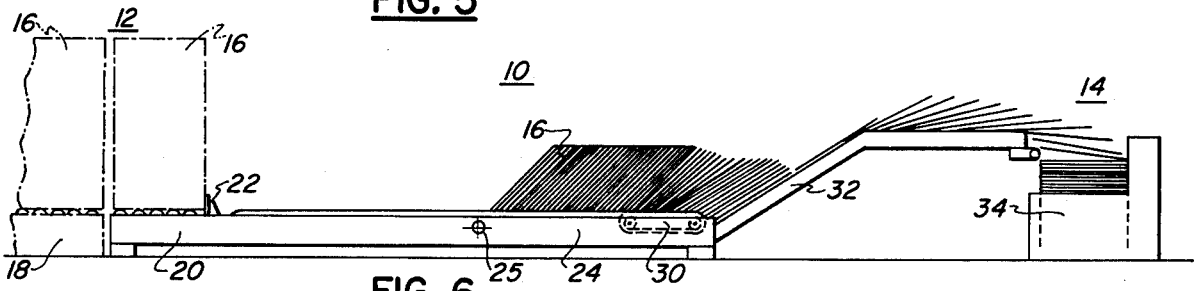

In FIGS. 1 and 6, the conveyor section 30 is on the same level as conveyor 24 and the conveyor 24 and the conveyor section 30 run at the same speed. In FIGS. 2, 3 and 4, the entrance end of conveyor section 30 is above the level of conveyor 24 so the sheets are precluded from entering upon conveyor section 30. In FIG. 5, the entrance end of conveyor section 30 is below the level of conveyor 24, to permit the movement of sheets onto conveyor section 30 to be accelerated. In this position of conveyor section 30, the sheets move onto it very rapidly.

In order to improve the operation of machine 10 and avoid clumping and gapping, it is advisable to support the sheets on their edges on conveyor 24. This will aid in the smooth flow of sheets from conveyor 24 onto conveyor section 30 and then onto an inclined conveyor 32 into a hopper which is one example of a terminus of the exit end 14. The sheets are supported on their edges on conveyor 24 by means of a support mechanism 36 which is in contact with the face of the leading sheet of the group so that the face of the leading sheet and the conveyor form an acute angle which faces the exit end 14.

Now that the apparatus of the preferred embodiment of the invention has been described in broad terms, one may proceed to a detailed description of the novel features of the machine 10.

Figure 7:
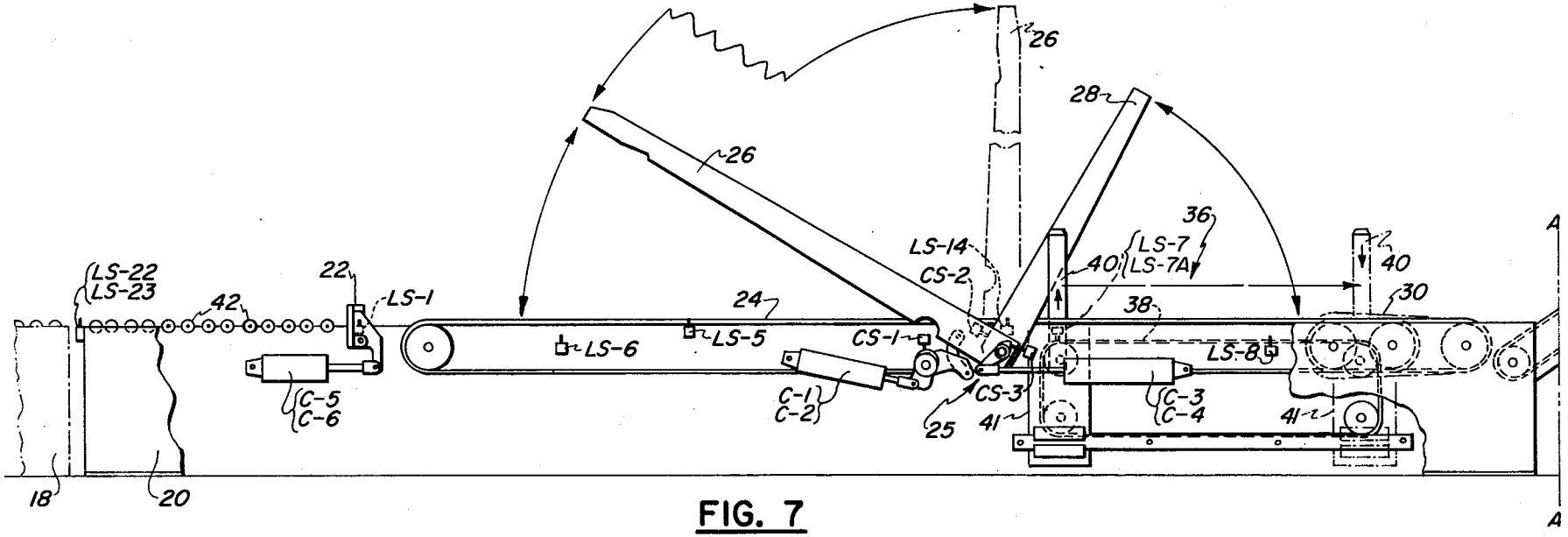
Figure 7A:
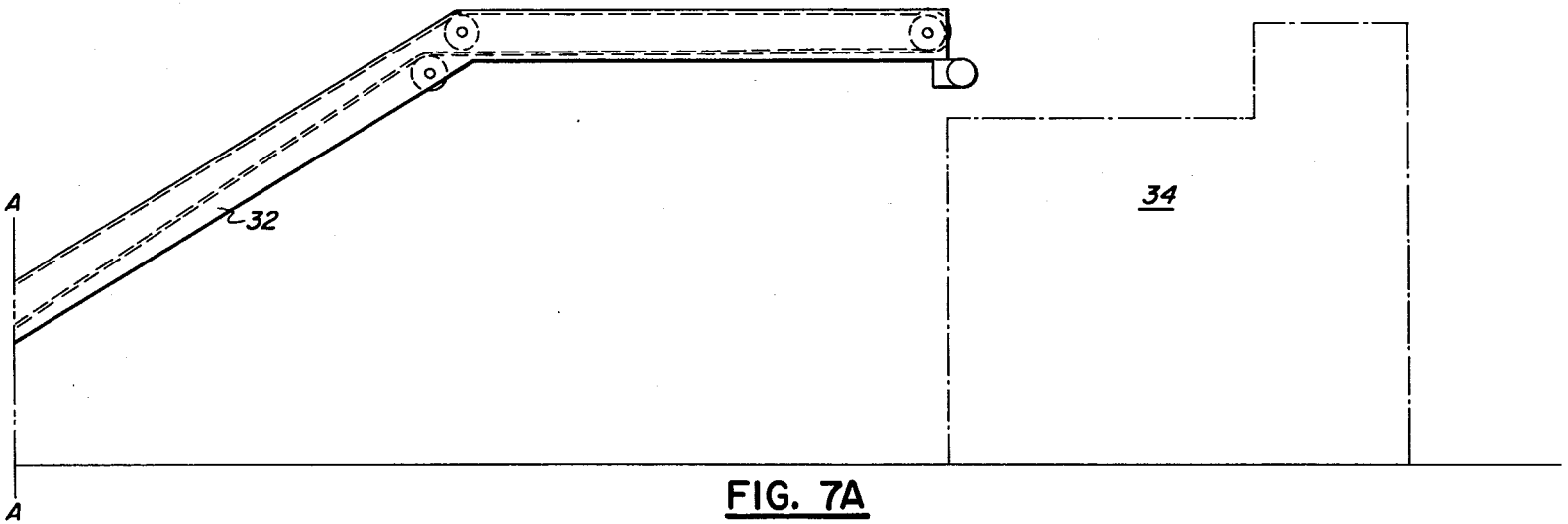
Figure 8:
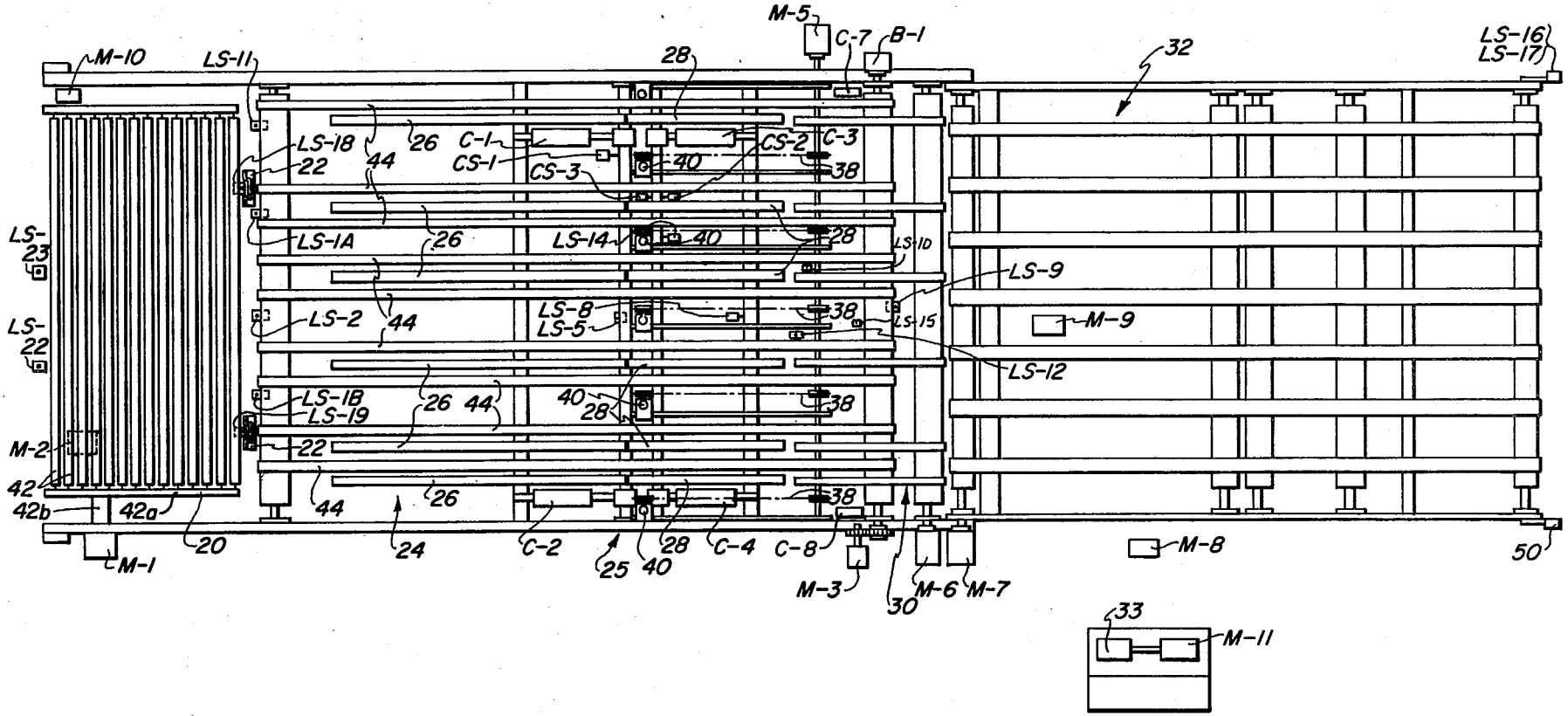
FIG. 8 is a horizontal plan view of the embodiment of FIGS. 1–7A on a somewhat smaller scale than that of FIGS. 7 and 7A.
Figure 10:
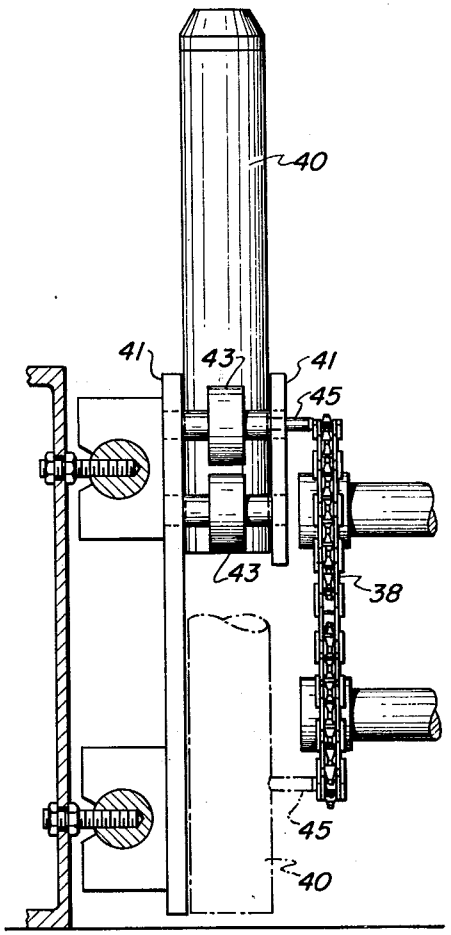
FIG. 10 is a view in the direction of arrows 10—10 of FIG. 9.
Figure 9:
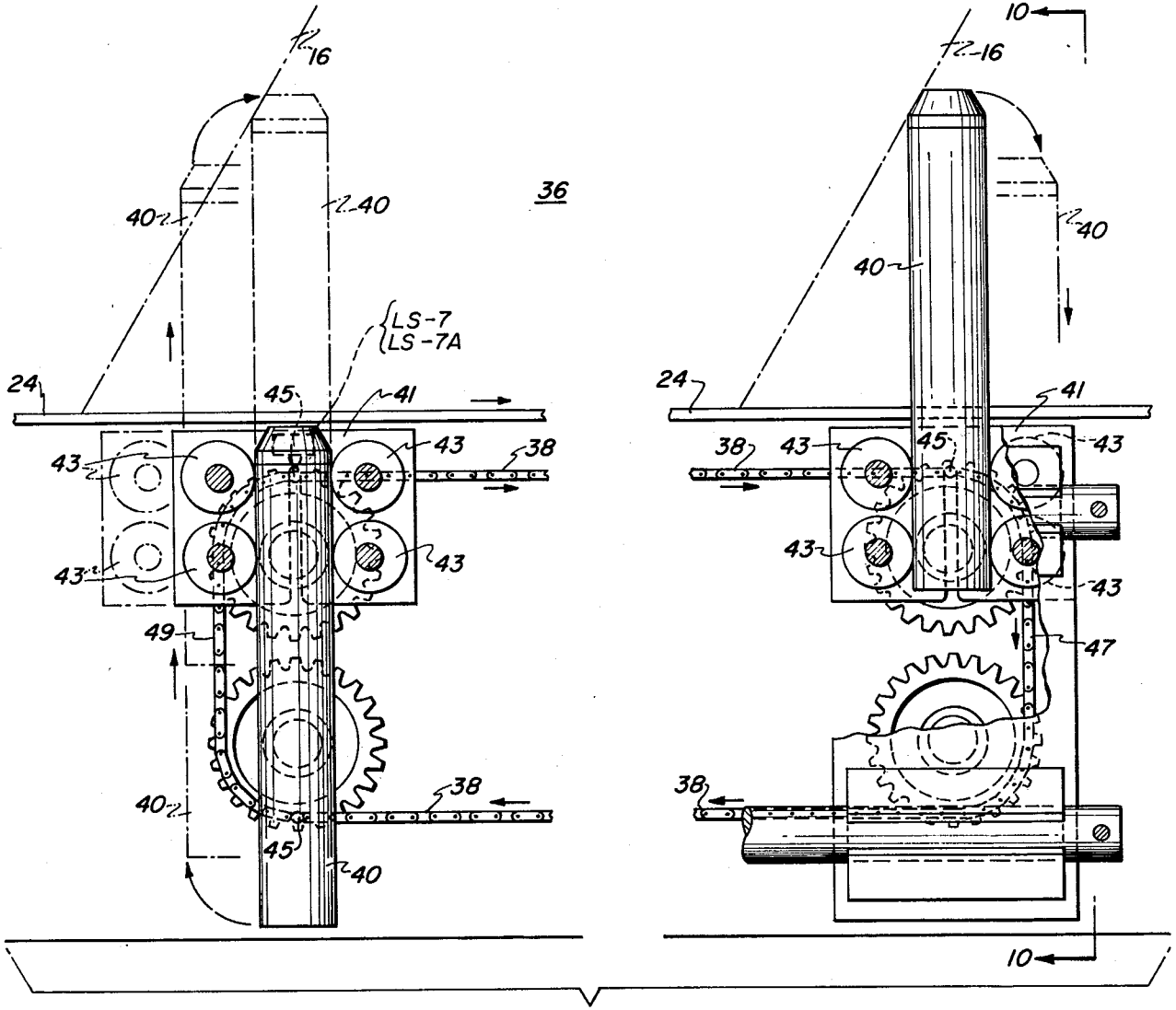
FIG. 9 is an enlarged, side elevational view of the support means of the invention.

FIGS. 7 and 7A, joined on lines A—A, together are a side elevational view of machine 10 and FIG. 8 on a smaller scale, is a plan view thereof. A stack of sheets 16 arrives on the customer's conveyor 18. As referred to herein, the "customer's conveyor" is intended to designate the existing materials handling system already in the plant as contradistinguished from the apparatus of the invention. Support means 36 preferably comprises a pair of longitudinally, extending, endless chains 38 and at least one support post 40. The chains 38 are spaced from each other transversely across the machine and a post 40 is attached to one of the chains. The post is contained in a block 41 whose function will be described later.

After the sheets reach the upset position 25 and the sheets are placed on their edges by forks 26 and 28 so they will be delivered to hopper 34 in the proper faced orientation, the sheets are held by support post 40. Support post 40, when the proper predetermined condition is reached, moves in synchronism with conveyor 24 so that the sheets supported on their edges are rapidly moved onto conveyor section 30. In this condition, the entrance end of conveyor section 30 is below the level of conveyor 24.

It may be advisable to utilize a plurality of posts 40. Commonly, there will be one near each side of the machine each tied to a chain 38. The chains 38 are run in synchronism.

Block 41 is provided with a set of rollers 43 which confine support post 40 and support post 40 is pinned to chain 38 by a pin 45. When the post 40 reaches the terminus 47 of chain 38 nearest the exit, it is carried down so that it is below the level of conveyor 24. As it returns toward the entrance, it pulls block 41 with it. When terminus 49 nearest the entrance is reached, the post is moved upward to its support position. It is seen that as post 40 is moved by chain 38 in the longitudinal direction, it moves block 41 in concert with it.

At the same time as the leading sheet contacts the trailing sheet of the preceding group, the post 40 is carried down and out of contact with the lead sheet and the sheets are shingled onto the sheets of the previous stack. If there is no preceding group and a clump is formed, the clump must be cleared manually and the first several sheets must be shingled by hand.

A stack of sheets 16 (stack 1) is delivered on infeed conveyor 20 from customer's conveyor 18 and is detected by limit switch LS-22, located at the front edge of infeed conveyor 20, and infeed conveyor motor M-2 starts if there is no stack on infeed conveyor 20. As the trailing edge of stack 1 leaves conveyor 18, switch LS-23 opens thereby stopping conveyor 18. Stack 1 moves on infeed conveyor 20 until it is stopped by gates 22. Switches LS-1A and LS-1B aid in the squaring of the stack to the gates 22. When both limit switches LS-1A and LS-1B are closed, customer's conveyor 18 is started and stack 2 is brought up to LS-22 and conveyor 18 stops. At the same time motor M-2 is also stopped. Using sensors LS-18 and LS-19, stack 1 is centered by means of motor M-1 which moves conveyor 20 to the desired transverse position. Conveyor 20 is seen to be comprised of rollers 42 carried by a subframe 42*a* which is coupled to motor M-1 for transverse movement of the conveyor 20 relative to conveyor 24 by means of a drive arrangement 42*b*.

After stack 1 is centered on conveyor 20, gates 22, which are operated by cylinders C-5 and C-6, drop and motors M-2 and M-3 start. Motor M-3 is a two speed motor and it drives belts 44 of conveyor 24 at its slow speed, say, about 30 feet per minute (FPM). Motor M-2 drives rollers 42 of infeed conveyor 20 at 30 FPM. Thus, stack 1 is moved onto conveyor 24 and after its trailing edge clears gates 22, switch LS-2 opens, gates 22 close and infeed conveyor motor M-2 stops.

Stack 1 proceeds to the upsetting position 25 and when the stack's trailing edge clears switch LS-5 and it opens, motor M-3 aided by brake B-1, stops and the movement of conveyor 24 stops. At the same time cylinders C-1 and C-2 are actuated to raise inner or rear forks 26 toward the rear of stack 1. At the same time, switch LS-14 is closed to help detect stack upset.

As inner forks 26 operated by cylinders C-1 and C-2 approach 75°, cam switch CS-1 closes thereby actuating cylinders C-3 and C-4 to raise the outer forks 28 and causing cylinders C-1 and C-2 to reverse to thereby start the retraction of inner forks 26. When the outer forks 28 reach an angle of about 45°, cylinders C-3 and C-4 stop to thereby stop forks or slats 28 in place. At the same time, inner forks or slats 26 continue to retract until they are fully retracted and switch LS-6 closes.

Chains 38 had previously stopped so that post 40 was forward of the upsetting position 25. When switch LS-6 closes motor M-5 is started so that chains 38 move clockwise until support post 40 is just in contact with the front of the first sheet and clear of forks 28. When this condition is detected by system LS-7 and LS-7A, outer forks 28 drop to their retracted position and the sheets resting on their edges will be supported by the post 40. When the outer forks 28 retract to their rest position, switch LS-8 closes.

When switch LS-8 closes, motor M-3 moves conveyor 24 at its fast speed, say, 90 FPM and motor M-5 moves chains 38 clock-wise at the same speed so that the conveyor 24 and support post 40 move in synchronism. At the same time, the entrance of conveyor section 30 drops to its lowest position so that stack 1 can be moved rapidly onto section 30. If switches LS-9 and LS-14 are clear and switch LS-9 closes as the stack reaches it, motors M-3 and M-5 continue to run. When the sheets close switch LS-10, cylinders C7 and C8 raise conveyor section 30 to its mid position as described more fully in the aforesaid application of George A. Ventz, Ser. No. 711,479, filed of even date herewith and motors M-3, M-6 and M-7 start to run main conveyor 24, conveyor section 30 and inclined conveyor 32 in synchronism at 30 FPM. Support post 40 continues to move until it is at upsetting position carried down below the level of conveyor 24. It then stops until the sheets clear switch LS-9, at which time it moves to its position forward of the upsetting position to await the next group of sheets.

The sheets of stack 1 continue to go forward while the actuation of switch LS-15 signalled gates 22 to open if another stack (stack 2) is on the infeed conveyor. When the sheets of stack 1 clear outer forks 28, switch LS-12 opens. Then the entrance of conveyor section 30 raises and conveyor 24 runs at its slow speed. At the same time, gates 22 open to admit stack 2 to enter main conveyor 24.

At the hopper 34, electric eye switches LS-16 and LS-17 operate in conjunction with reflector 50 to detect the contents of the hopper. Switch LS-17 is above LS-16 so that when the optical path between LS-17 and reflector 50 is interrupted by the hopper contents, motor M-6 and motor M-7 stop so that the conveyor section 30 and inclined conveyor 32 stop. If the sheets of stack 1 are still on conveyor 24, motor M-3 will also stop until the level of hopper 34 drops and electric eye LS-17 is clear.

Electric eye LS-16 senses the low level of the sheets in the magazine 34. If the level falls below the desired value, a control is actuated to stop the operation of the following apparatus, e.g. a printer-slotter. The printer-slotter remains off until a sufficient number of sheets are delivered to the magazine or hopper 34.

Motors M-1, M-2, M-10 and M-11 are electric motors and motors M-3, M-5, M-6 and M-7 are hydraulic motors. M-11 is the hydraulic pump motor to operate pump 33 for supplying power to the hydraulic motors.

It should be understood that while the forks operate to deliver the shingled sheets in the same faced orientation at which they reach the apparatus, they operate with equal facility on stacks on which the faced orientation is reversed in the apparatus.

While a particular embodiment of the apparatus of the invention has been shown and described it is apparent to those skilled in the art that modifications are possible without departing from the spirit of the invention or the scope of the subjoined claims.

The embodiments of the invention in which an exclusive property or privilege is claimed are defined as follows:

1. Apparatus having an entrance and an exit for receiving a stack of horizontal sheets such as flat, corrugated paperboard sheets at the entrance and feeding them to thereby deliver the same toward the exit in a shingled fashion comprising:

a conveyor;

means for delivering the stack of horizontal sheets to the conveyor;

means associated with the conveyor for moving the stack of sheets into a position in which the sheets form a group resting on the edges of the sheets and wherein the faces of the group of sheets and the conveyor form an acute angle facing the exit such that the sheets will be delivered to the exit in the desired faced orientation;

support means for supporting the group of sheets at the leading end of the group to preclude the sheets from falling to a horizontal posture onto the conveyor until a first predetermined condition has been reached, said support means being movable between a first position when it is below the level of the conveyor and the sheets are free to drop onto the conveyor and a second position when it is above the level of the conveyor and supports the sheets on their edges;

moving means for moving the support means toward and away from the exit;

actuating means for actuating the moving means to move the support means toward the exit while supporting the sheets on their edges when a second predetermined condition has been reached and for actuating the moving means to move the support means toward the entrance below the level of the conveyor when the first predetermined condition has been reached;

the leading sheet resting against the trailing sheet of the previous group when the first predetermined condition has been reached.

2. The apparatus of claim 1 wherein the support means comprises:

at least one longitudinally extending endless chain;

at least one post pinned to the chain such that it moves longitudinally with the chain and vertically downward at the terminus of travel of the endless chain closest to the exit and vertically upward at the terminus of travel of the endless chain closest to the entrance.

3. The apparatus of claim 2 including:

a block having rollers affixed thereto;

the post being confined in the rollers such that movement of the post longitudinally moves the block in concert therewith.

4. The apparatus of claim 4 wherein there is a plurality of such posts.

5. The apparatus of claim 3 wherein there is a plurality of such posts.

6. The apparatus of claim 2 wherein there is a plurality of such posts.

* * * * *